United States Patent [19]

Shibata

[11] Patent Number: 4,514,238

[45] Date of Patent: Apr. 30, 1985

[54] INTERNALLY OXIDIZED AG-SN-BI ALLOY ELECTRICAL CONTACT MATERIALS

[75] Inventor: Akira Shibata, Yokohama, Japan

[73] Assignee: Chugai Denki Kogyo K.K., Japan

[21] Appl. No.: 666,032

[22] Filed: Oct. 29, 1984

Related U.S. Application Data

[63] Continuation-in-part of Ser. No. 586,877, Mar. 8, 1984, abandoned, which is a continuation of Ser. No. 347,500, Feb. 10, 1982, abandoned.

[30] Foreign Application Priority Data

Feb. 12, 1981 [JP] Japan ..... 56-18096
May 2, 1981 [JP] Japan ..... 56-66185

[51] Int. Cl.[3] ..... C22C 5/06

[52] U.S. Cl. ..... 148/431; 420/501; 420/506

[58] Field of Search ..... 148/430, 431; 420/501, 420/506

[56] References Cited

U.S. PATENT DOCUMENTS 4,150,982 4/1979 Shibata ..... 148/431

*Primary Examiner*—L. Dewayne Rutledge
*Assistant Examiner*—Christopher W. Brody
*Attorney, Agent, or Firm*—Shlesinger Fitzsimmons Shlesinger

[57] ABSTRACT

Internally oxidized Ag-Sn-Bi alloy electrical contact materials. The alloy contains a larger amount of Bi, viz., more than 2 weight percent of bismuth, whereby the Bi which can not be a solid solution with Ag and Sn and hence precipitates as a numerous number of defects in an Ag matrix, does not allow said Ag matrix to form crystalline grains, but accelerates oxidation velocity and has solute metals oxidized extremely in minute and uniform up to inner cores of alloy mass.

1 Claim, 2 Drawing Figures

INTERNALLY OXIDIZED AG-SN-BI ALLOY ELECTRICAL CONTACT MATERIALS

CROSS-REFERENCES TO RELATED APPLICATIONS

This application is a continuation-in-part application of my pending U.S. application Ser. No. 586,877, filed Mar. 8, 1984, now abandoned and which application in turn was a continuation of my U.S. application Ser. No. 347,500, filed Feb. 10, 1982, now abandoned.

BRIEF SUMMARY OF THE INVENTION

Ag base alloys containing as solute metals thereof one or more of Cd, Sn, Zn, In and so on whithin a range of their solid solubility with Ag, which are subjected to internal oxidation and solute metals of which are precipitated as metal oxides thereof in the silver matrices, are widely known as useful for electrical contact materials. Indeed, they are extensively utilized today as electrical contacts for various applications in electrical industry. Those silver-metal oxides contact materials which are described in U.S. Pat. No. 3,874,491 and in U.S. Pat. No. 3,933,485 are good examples of them.

Characteristic features common to them are enumerated hereunder.

(1) Alloys before internal oxidation can be forged and rolled to a great extent, (2) In the alloys after internal oxidation, there are seen a number of silver crystalline grain boundaries, (3) Metal oxides are precipitated of the most part along said boundaries of silver crystal grains, (4) The alloys after internal oxidation, especially those having a high concentration rate of solute metals can hardly be subjected to cold working, because silver crystalline grain boundaries shall be destroyed by cold working, and (5) As mentioned in the above (2) and (3), the production of metal oxide precipitates and existence thereof are dependent on and influenced by silver crystalline grain boundaries, whereby concentration thereof becomes lesser in the progressive directions of internal oxidation, and cold working destructs such structural bases.

In respect of these characteristic features, electrical contact materials such as disclosed in U.S. Pat. No. 3,933,486 and U.S. Pat. No. 4,242,135, solute metals of which are substantially equal to electrical contact materials of the present invention, are not exceptional. To wit, in these prior known electrical contact materials, which are obtained by internal oxidation of an alloy containing in a silver matrix 3 to 20 weight percent of tin, 0.01 to 1.0 weight percent of bismuth, and with or without the addition of 0.1 to 8.5 weight percent of copper and of less than 0.5 weight percent of one or more elements of the iron family, the solute metals are diffused in the boundaries of silver crystal grains rather than through the crystal grains. They have thin oxide imbricate films which are formed in the boundaries of the silver crystal grains of about 50$\mu$ at their average diameter.

In contrast to the above-mentioned materials, Ag-Sn alloys for electrical contact materials which contain a specific amount of bismuth in accordance with this invention and are subjected to selective internal oxidation, are characterized by the following features.

(1') Present invention alloys before internal oxidation can hardly be forged and rolled, (2') In the present alloys after internal oxidation, there are scarcely seen any silver crystalline boundaries, (3') Hence, metal oxides are not precipitated in silver crystal grain boundaries, but they are mostly precipitated in silver matrices themselves, (4') Since metal oxide precipitates of the present alloys are more minute than those of the aforementioned kind of prior known alloys on account of employment of Bi in an excessive amount, since there are not produced silver grain boundaries, and since oxidized structures of the present alloys are uniform throughout thereof from surface portions to inner core deep portions, their original ductility does not decrease even after internal oxidation thereof but rather increases, and they can be subjected to cold working even after the internal oxidation, and (5') Present alloys have structures resembling those of alloys which are powder metallurgically prepared by powders of silver and metal oxides, while the former have thick structures and the latter have coarse ones, and the present alloys contain metal oxides which are precipitated spherically throughout their overall silver matrices.

When comparing the above characteristic features (1)-(5) of known alloy contact materials with those of the present invention alloys, viz., the features (1') through (5'), feature (1') is apparently disadvantageous, since the present invention alloys require rather complicated processes for forming them to desired contact shapes. However, the above-mentioned features (2') to (5') afforded to the present invention alloys would compensate well the disadvantageous feature (1').

It shall be needless to say, but the above disadvantageous feature (1') occured on account of the employment of bismuth at an amount by which it can hardly be capable to form the solid solution with silver and tin in ambient temperature and it can not provide alloys with an acceptable rate of elongation.

In silver-tin alloys containing bismuth, Bi can scarcely be a solid solution with them at ambient temperature, and is precipitated in Ag-Sn alloy substrata, as known by silver-bismuth and tin bismuth equilibrium diagrames. In this invention, however, this bismuth is intentionally employed in an excessive amount so as to produce in the Ag-Sn alloy substrata a great number of defects on account of Bi precipitates, resulting in giving the alloys the aforementioned advantageous feature (2') to (5'). It shall be noted also that the employment of Bi in such large amount extremely accelerates internal oxidation velocity of Ag-Sn alloys.

In order to achieve the above end, the amount of Bi is more than 2 weight % to 5.5 weight %. In this instance, the minimum amount of Sn is more than 6 weight %, since otherwise, Bi amount shall be too large compared to Sn amount. When alloys contain more than 20 weight % of Sn, it can not be completely internally oxidized even in accordance with this invention. Needless to say, but a part of Sn can be substituted by one or more of Cd, Cu, Zn, Sb, In, Pb, Mn and so on in such amount by which they can be the solid solution with Ag and can be internally oxidized.

Present electrical contact materials can be prepared by the following steps, for example.

A: Mixture of powders of alloy constituent metals or mixture of alloy constituent metals with metal oxides as a part thereof→(reduction) sintering→shaping→internal oxidation.

B: Casing of alloy→powdered→molding→sintering (under non-oxidation atmosphere)→shaping→internal oxidation.

C: Casting of alloy→dimension to discal or short wire pieces→internal oxidation→shaping→annealing In each above steps, materials obtained thereby would be subjected to solution treatment so that their workability can be increased.

DETAILED DESCRIPTION OF THE INVENTION

Examples of this invention are given hereinunder.

EXAMPLE 1

In a high-frequency heated graphite crucible (of 500 g capacity), alloy of Ag-Sn 8 weight % (hereinafter % being always weight percent)-Bi 2.1%-Ni 0.2% was melted. This alloy was poured into a number of cavities (each of 5.5 mm in diameter and of 2.5 mm in depth) provided to a graphite mold. Discal casts thus obtained were polished of their outer surfaces in a barrel.

They were thereafter internally oxidized under $O_2$ atmosphere of 7 atm, at 600° C. for 48 hours. They were shaped under a pressure of 5 Ts/cm$^2$ to disks of 6 mm in diameter and 2.0 mm in thickness. They were then annealed at an $O_2$ atmosphere of 800° C. for 2 hours. Discal contact materials thus prepared were each brazed by B-CuP No. 5 onto a copper contact base leaf.

Figure 1A:
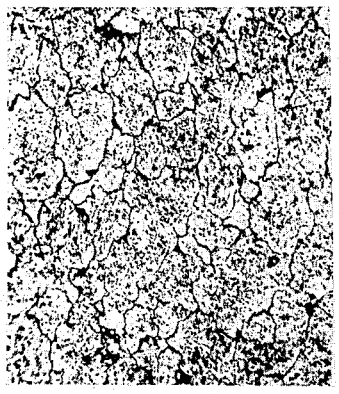
FIG. 1*a* is a similar microphotographic picture (×200) of prior known Ag-Sn 8 w%-In 3 w%-Ni 0.2 w% contact material.
Figure 1B:
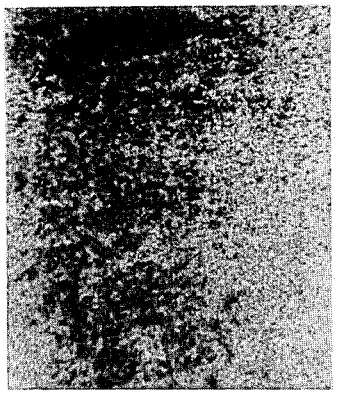
FIG. 1*b* is a microphotographic picture (×200) of a vertical sectional structure of an Ag-Sn-Bi contact material made in accordance with this invention.

Said discal contact materials were vertically cut to observe their sectional structures. As shown in FIG. 1*b*, they had structures characterized by features (2') to (5') as explained above. As a comparison, an internally oxidized contact material of Sn 8%-In 3%-Ni 0.2% which is sold under a trademark "Neosilcon" of Chugai Denki Kogyo Kabushiki-Kaisha or Chugai Electric Industrial Co., Ltd., Tokyo, Japan, the present patent applicant company, and which is known in the market as one of the most excellent contact materials of this kind of today, was also observed of its structure by microscope (×200), as shown in FIG. 1*b* in which the aforementioned characteristic features (2) to (5) are confirmed.

Alloy of Ag-Sn 6%-Zn 3%-Bi 2.1% was also prepared to discal contact materials.

The above three contact specimens, that is, (I) Ag-Sn 8%-Bi 2.1%-Ni 0.2% (of this invention)

(II) Ag-Sn 6%-Zn 3%-Bi 2.1% (of this invention)

(III) Ag-Sn 8%-In 3%-Ni 0.2% (of one of conventional most excellent electrical contacts)

were subjected to the following tests. Their results are given also in the following.

Their hardness (HRF) and electric conductibility (IACS%) are as follows.

| | Hardness | Conductibility |
|---|---|---|
| (I) | 88 | 67 |
| (II) | 91 | 56 |
| (III) | 79 | 60 |

ASTM consumption test:
Voltage: AC 200 V 50 Hz
Current: 90 A
Power factor: 0.22 (inductive)
Switching frequency: 60 times/minute
Switching: 15,000 times
Contact force: 400 g
Releasing force: 600 g
Lamp loaded welding test:
Voltage: AC 200 V 50 Hz
Load: 200 V 200 W 50 tungsten bulbs
Current: 50 A (steady-state current) 514–565 A (rush current)
Contact gap: 1.8 mm
Contact force: 60 g
Switching: 50 times
Results:

| | ASTM consumption (mg) | Welding | |
|---|---|---|---|
| | | welding rate (%) | welding force (g) |
| (I) | 5.6 | 12 | 25 |
| (II) | 12.1 | 13 | 62 |
| (III) | 3.5 | 32 | 58 |

It is thus known that contact materials made in accordance with this invention have comparatively low contact resistance and consumption rates, and their anti-welding characteristics are excellent.

EXAMPLE 2

Ag-Sn 6%-Bi 2.1% alloy which can be prepared by melting, but a cast ingot of which can neither be drawn to wires nor rolled, was casted directly from its molten to a wire of 6 mm diameter by a continuous casting method. The wire was cut into short wire pieces of 2 mm length. They were internally oxidized under $O_2$ atmosphere of 3 atm at 700° C. Time required for completely internally oxidizing said pieces up to inner cores was as short as about 4 to 5 hours, compared to about 48 hours for the internal oxidation of Ag-Sn-Bi alloy containing of its Bi at less than 1 weight percent. Metal oxides precipitated in Ag matrices were as small as about 5$\mu$ which is one tenth of precipitates of conventional Ag-Sn-Bi alloys. But, disadvantageously, the said pieces were brittle on account of oxidizing expansion, and their hardness was only about HRF 30–40. Hence, they were compacted under about 4 Ts/cm$^2$, and sintered in an $O_2$ atmosphere of 1 atm at 800° C., whereby the hardness became to about HRF 80.

They were subjected to the same tests as in Example 1, resulting in showing that they stood well against welding, that is, they scarcely welded under the tested conditions, and that hence, they had low contact resistance.

It was also realized that less than 0.5 weight percent of ferrous metals could be desirably added for preventing the cracks from forming at the time of internal oxidation as a result of the increased rate of solute metal elements in the silver alloy.

I claim:

1. An electrical contact material comprising an alloy of silver and solute metal elements, said alloy having a matrix consisting of silver, said solute metal elements comprising more than 6 weight percent to 20 weight percent of Sn, and an additive for accelerating the internal oxidation of said alloy consisting essentially of more than 2 weight percent to 5.5 weight percent of Bi, and said alloy being completely internally oxidized so that said solute metal elements are present in said alloy totaly as oxides which are very finely precipitated throughout said silver matrix, said matrix presenting substantially no silver grain crystalline boundaries.

* * * * *